US006189242B1

(12) United States Patent
Lin

(10) Patent No.: US 6,189,242 B1
(45) Date of Patent: Feb. 20, 2001

(54) SHOE FOR BICYCLE

(76) Inventor: Mikel Lin, 20F, No. 201, Sec. 1, Chong Gang Road, Taichung (TW)

( * ) Notice: Under 35 U.S.C. 154(b), the term of this patent shall be extended for 0 days.

(21) Appl. No.: 09/449,949

(22) Filed: Nov. 29, 1999

(51) Int. Cl.[7] ..... A43B 13/12; A43B 5/00
(52) U.S. Cl. ..... 36/131; 36/30 R; 36/117.1
(58) Field of Search ..... 36/131, 114, 115, 36/117.1, 117.2, 30 R

(56) References Cited

U.S. PATENT DOCUMENTS 5,205,056 * 4/1993 Okajima et al. ..... 36/131
5,363,526 * 11/1994 Okajima ..... 36/131
5,446,977 * 9/1995 Nagano et al. ..... 36/131
5,611,152 * 3/1997 Richard et al. ..... 36/30 R
5,685,093 * 11/1997 Lin ..... 36/131
5,687,492 * 11/1997 Muraoka ..... 36/131
5,878,514 * 3/1999 Ueda et al. ..... 36/131
5,924,220 * 7/1999 Ueda et al. ..... 36/131
5,943,795 * 8/1999 Ueda et al. ..... 36/131
6,009,641 * 1/2000 Ryan ..... 36/131

* cited by examiner

*Primary Examiner*—Paul T. Sewell
*Assistant Examiner*—Anthony Stashick
(74) *Attorney, Agent, or Firm*—Charles E. Baxley

(57) ABSTRACT

A shoe for a bicycle includes an outsole having a depression for receiving a board and having an opening for receiving a coupler. The board has a recess for receiving a fastener plate. One or more fasteners are engaged through the coupler and the board and threaded to the fastener plate for securing the coupler to the board. A shoe upper includes a peripheral flange engaged onto the board and an insole has a peripheral portion snugly engaged with the peripheral flange of the shoe upper. The insole has a pivotal flap received in the recess and engaged with the fastener plate.

6 Claims, 5 Drawing Sheets

SHOE FOR BICYCLE

BACKGROUND OF THE INVENTION

1. Field of the Invention

The present invention relates to a shoe, and more particularly to a shoe for bicycle.

2. Description of the Prior Art

One typical shoe for attaching onto the bicycle is shown in FIGS. 5–7 and comprises an outsole 93 including an opening 96 formed therein for receiving a coupler 95 which is to be coupled to a pedal 97 (FIG. 4) of the bicycle for solidly securing the shoe to the pedal 97 and for preventing the shoe from being disengaged from the pedal 97. A shoe upper 90 includes a peripheral flange 91 extended inward from the bottom peripheral portion thereof and engaged into the outsole 93. An insole 92 and a pad 94 are engaged in the shoe upper 90. The insole 92 includes two oblong holes 921 formed therein for threading the fasteners 951 and includes a recess 922 formed therein for receiving a fastener plate 99 which is preferably made of metal materials. The fasteners 951 are threaded through the oblong holes 921 of the insole 92 and are threaded to the fastener plate 99 for securing the coupler 95 to the insole 92. The insole 92 and the shoe upper 90 and the outsole 91 are secured together by such as the adhesive materials, and may further be solidly secured together with stitches. For allowing the coupler 95 to be secured to the insole 92 with the fasteners 951, the insole 92 should be made of materials having a suitable strength for preventing the insole 92 from being deformed and for stably and solidly retaining the coupler 95 to the insole 92. Accordingly, a gap 98 should be formed between the outsole 93 and the insole 92, such that the insole 92 may not be solidly secured to the outsole 93 and such that the coupler 95 may become loose relative to the outsole 93 when the insole 92 is loosen relative to the outsole 93. The dirt may enter into the gap 98 formed between the outsole 93 and the insole 92, such that the insole 92 may further be easily disengaged from the outsole 93. Especially, the peripheral flange 91 may not be formed flat when the peripheral flange 91 is bent radially inward from the bottom peripheral portion of the shoe upper 90.

The present invention has arisen to mitigate and/or obviate the afore-described disadvantages of the conventional shoes for bicycles.

SUMMARY OF THE INVENTION

The primary objective of the present invention is to provide a shoe for a bicycle including a coupler and an insole solidly secured to the outsole.

In accordance with one aspect of the invention, there is provided a shoe for a bicycle comprising an outsole including a depression and an opening for receiving a board and a coupler, the board including an upper recess for receiving a fastener plate, a shoe upper including a bottom peripheral flange engaged onto the board, an insole engaged into the shoe upper and engaged with the peripheral flange of the shoe upper, and means for fastening the coupler to the plate.

The board includes at least one notch formed in the upper portion and communicating with the recess of the board for reaching the fastener plate. The fastener means includes at least one fastener engaged through the coupler and the board and threaded to the fastener plate. The insole includes a peripheral shoulder for receiving the peripheral flange of the shoe upper and for snugly securing the insole to the shoe upper.

The insole includes a flap dependent therefrom and pivotally secured thereto at a live hinge, the flap is received in the recess of the board and engaged with the fastener plate. The flap includes a thickness greater than that of the insole for filling in the recess of the board together with the fastener plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
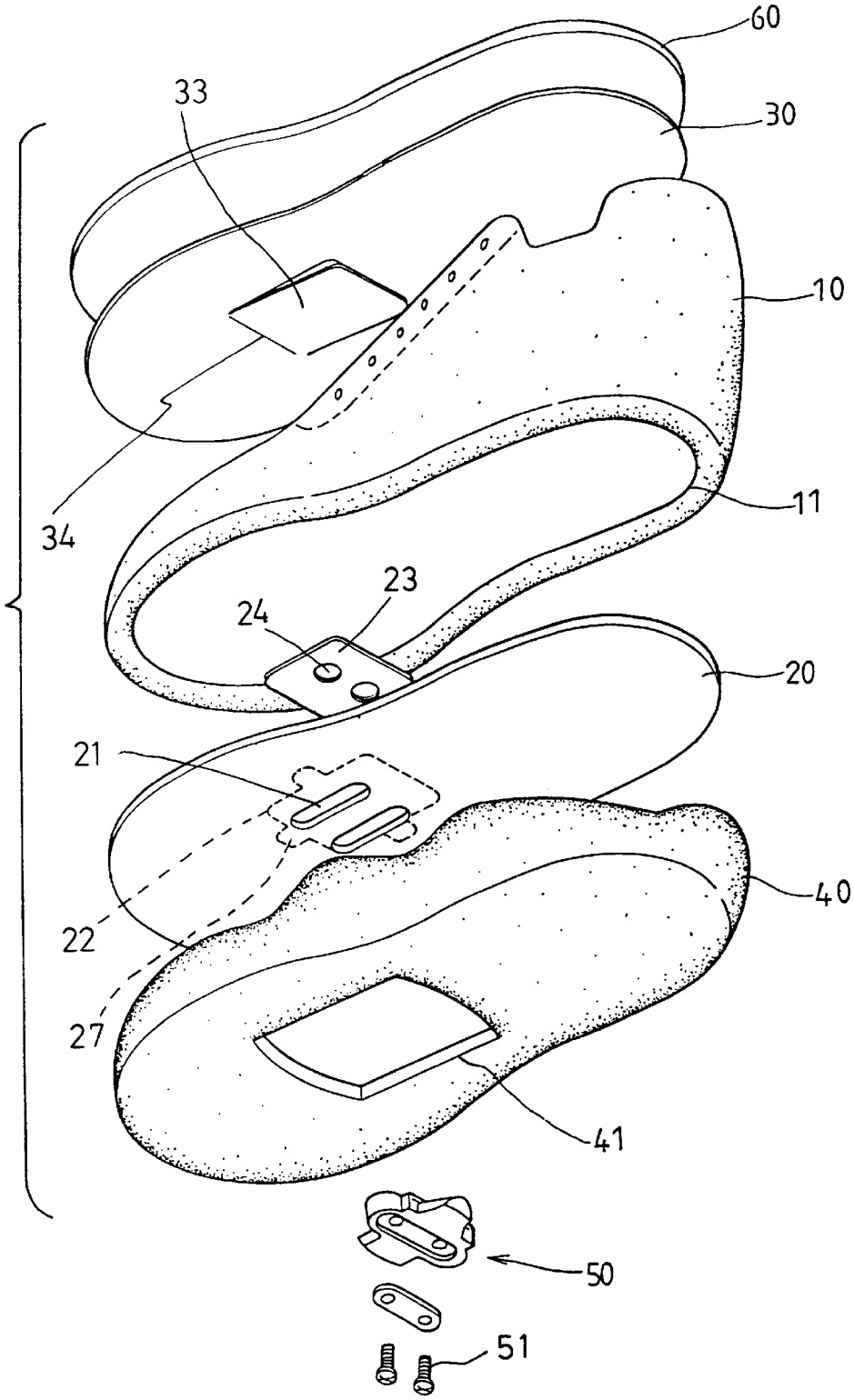
FIG. 1 is an exploded view of a shoe in accordance with the present invention.
Figure 2:
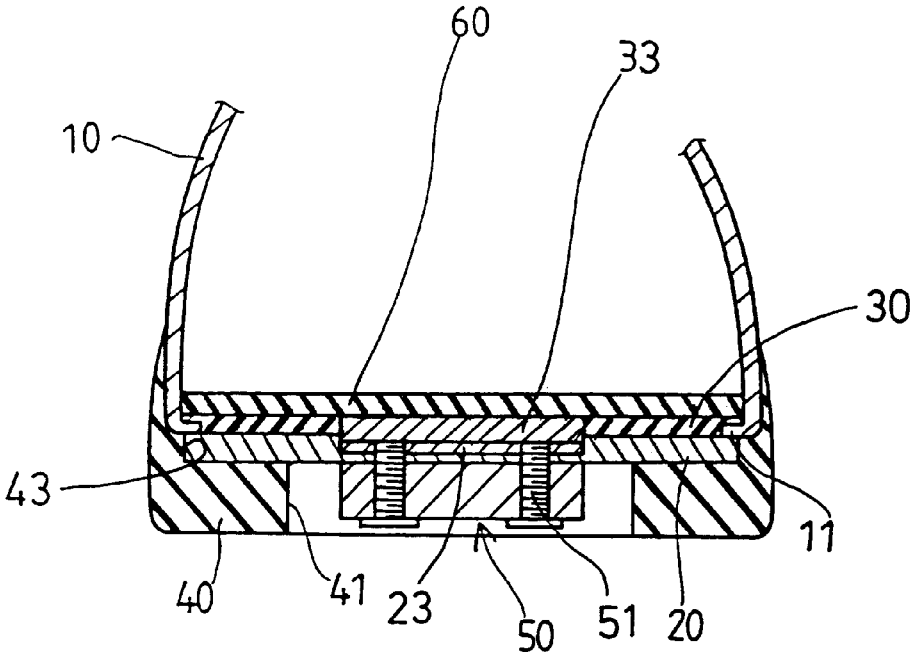
FIG. 2 is a lateral cross sectional view of the shoe.
Figure 3:
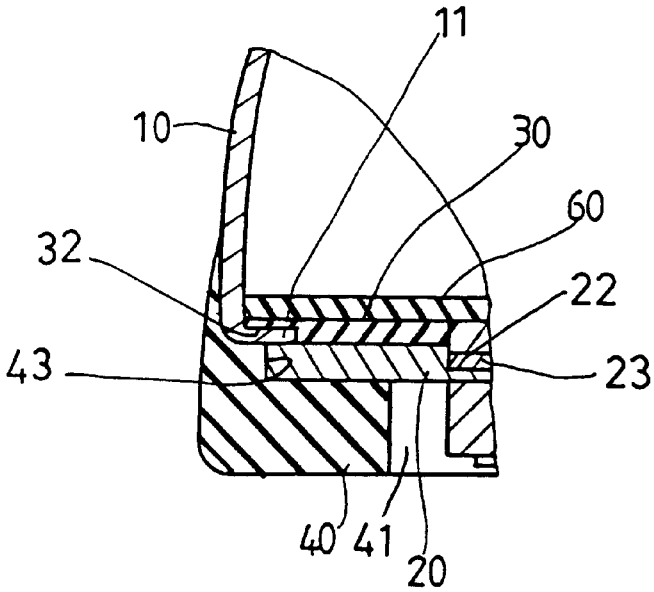
FIG. 3 is an enlarged partial cross sectional view of the shoe.
Figure 4:
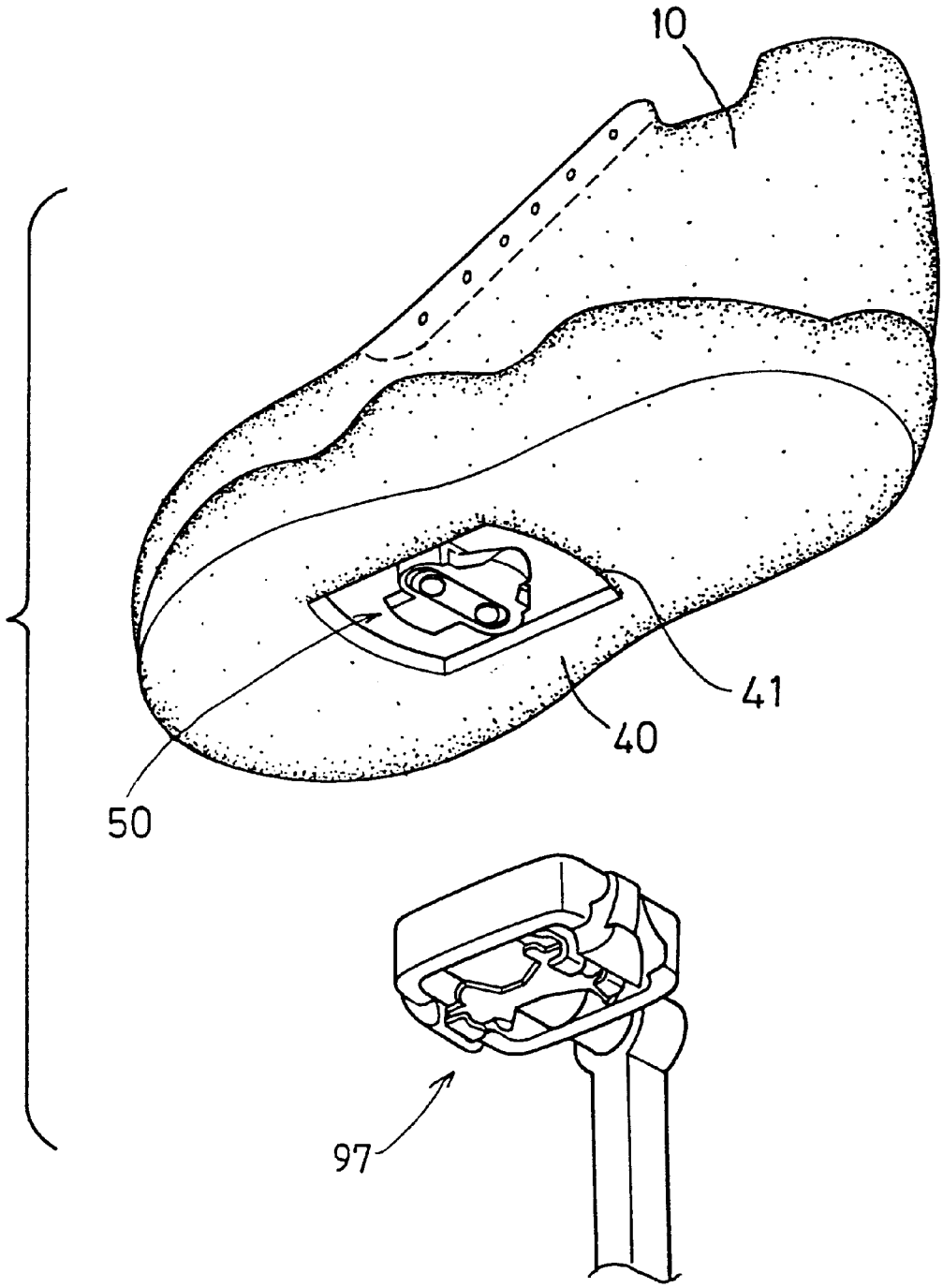
FIG. 4 is an exploded view illustrating the application of the shoe to the pedal of the bicycle.
Figure 5:
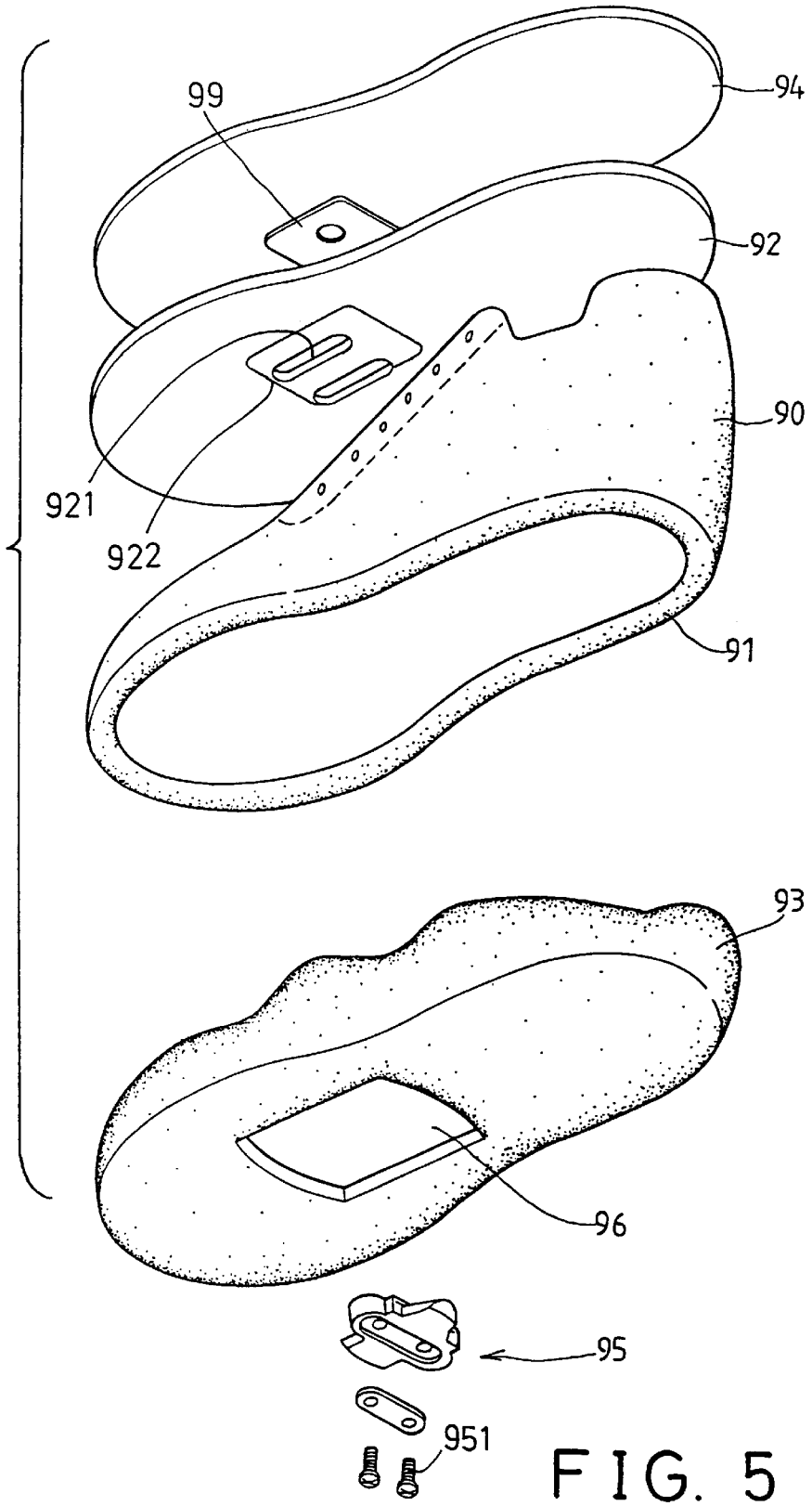
FIG. 5 PRIOR ART
FIG. 5 is an exploded view of a typical shoe for attaching to the bicycle.
Figure 6:
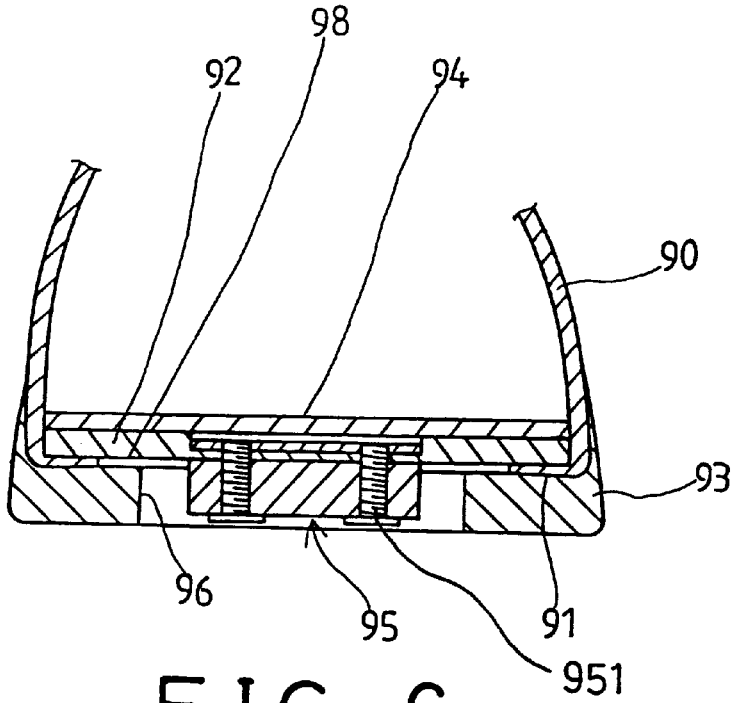
FIG. 6 PRIOR ART
FIG. 6 is a lateral cross sectional view of the typical shoe.
Figure 7:
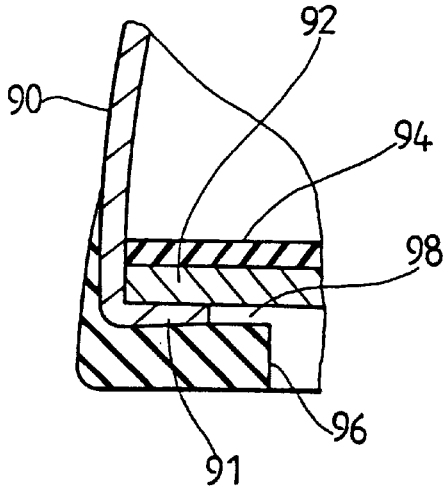
FIG. 7 PRIOR ART
FIG. 7 is an enlarged partial cross sectional view of the typical shoe.

Referring to the drawings, and initially to FIG. 4, a shoe in accordance with the present invention is provided for attaching onto a pedal 97 of a bicycle. As shown in FIGS. 1–4, the shoe comprises an outsole 40 including an opening 41 formed therein for receiving a coupler 50 which is to be coupled to a pedal 97 (FIG. 4) of the bicycle for solidly securing the shoe to the pedal 97 and for preventing the shoe from being disengaged from the pedal 97. The outsole 40 includes a depression 43 formed therein for receiving a board 20 which is engaged into the outsole 40 and which is made of materials having a suitable strength for preventing the board 20 from being deformed and for stably and solidly retaining the coupler 50 to the board 20. The board 20 includes one or more holes, particularly two oblong holes 21 formed therein for threading the fasteners 51 and includes a recess 22 formed in the upper portion thereof for receiving a fastener plate 23 which is preferably made of metal materials and which includes one or more screw holes 24 formed therein. The fasteners 51 are threaded through the oblong holes 21 of the board 20 and are threaded to the fastener plate 23 for securing the coupler 50 to the board 20. The board 20 includes one or more notches 27 formed in the upper portion thereof and communicating with the recess 22 thereof for reaching the fastener plate 23 and for allowing the user to easily engage and disengage the fastener plate 23 into the recess 22 of the board 20.

A shoe upper 10 includes a peripheral flange 11 extended inward from the bottom peripheral portion thereof and engaged onto the peripheral portion of the board 20. An insole 30 and a pad 60 are engaged in the shoe upper 10, in which the insole 30 is engaged with the peripheral flange 11 of the shoe upper 10. The insole 30 may be made of soft or resilient or cloth materials and may be deformed when the insole 30 is forced or pressed to engage with the peripheral flange 11 of the shoe upper 10. Or, relatively, as best shown in FIG. 3, the insole 30 may include a peripheral shoulder 32 formed therein for receiving the peripheral flange 11 of the shoe upper 10 and for allowing the insole 30 to be tightly and snugly secured to the shoe upper 10 and the board 20. It is preferable that the insole 30 includes a flap 33 dependent from the middle portion thereof and pivotally secured to the insole 30 at a live hinge 34 for allowing the flap 33 to be engaged into the recess 22 of the board 20 and to be engaged onto the fastener plate 23. The flap 33 may include a greater thickness than that of the insole 30 for snugly filling into the recess 22 of the board 20 after the fastener plate 23 is engaged into the recess 22 of the board 20. The insole 30 and the shoe upper 10 and the board 20 and the outsole 11 may be secured together by such as the adhesive materials, and may further be solidly secured together with stitches. The insole 30 and the board 20 may be made of plastic materials, paper materials, etc.

Accordingly, the shoe in accordance with the present invention includes a coupler and an insole which may be solidly secured to the outsole.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shoe for a bicycle, said shoe comprising:

an outsole including a depression formed therein and including an opening formed therein, a coupler received in said opening of said outsole, a board received in said depression of said outsole, said board including an upper portion having a recess formed therein, a fastener plate received in said recess of said board, a shoe upper including a bottom peripheral portion having a peripheral flange extended inward therefrom and engaged onto said board, an insole engaged into said shoe upper and engaged with said peripheral flange of said shoe upper, and fastener means for fastening said coupler to said fastener plate.

2. The shoe according to claim 1, wherein said board includes at least one notch formed in said upper portion thereof and communicating with said recess of said board for reaching said fastener plate.

3. The shoe according to claim 1, wherein said fastener means includes at least one fastener engaged through said coupler and said board and threaded to said fastener plate.

4. The shoe according to claim 1, wherein said insole includes a peripheral shoulder formed therein for receiving said peripheral flange of said shoe upper and for allowing said insole to be snugly secured to said shoe upper.

5. The shoe according to claim 1, wherein said insole includes a flap dependent therefrom and pivotally secured thereto at a live hinge, said flap is received in said recess of said board and engaged with said fastener plate.

6. The shoe according to claim 5, wherein said flap includes a thickness greater than that of said insole for filling in said recess of said board together with said fastener plate.

* * * * *